US009542791B2

(12) United States Patent
Schild et al.

(10) Patent No.: US 9,542,791 B2
(45) Date of Patent: Jan. 10, 2017

(54) SELF-CHECKING CASH BOX

(71) Applicant: WINCOR NIXDORF INTERNATIONAL GmbH, Paderborn (DE)

(72) Inventors: Michael Schild, Paderborn (DE); Sascha Ringel, Rietberg (DE)

(73) Assignee: WINCOR NIXDORF INTERNATIONAL GMBH, Paderborn (DE)

( * ) Notice: Subject to any disclaimer, the term of this patent is extended or adjusted under 35 U.S.C. 154(b) by 0 days.

(21) Appl. No.: 14/765,886

(22) PCT Filed: Feb. 7, 2014

(86) PCT No.: PCT/EP2014/052429

§ 371 (c)(1),
(2) Date: Aug. 5, 2015

(87) PCT Pub. No.: WO2014/122261

PCT Pub. Date: Aug. 14, 2014

(65) Prior Publication Data

US 2015/0379800 A1 Dec. 31, 2015

(30) Foreign Application Priority Data

Feb. 8, 2013 (EP) ..... 13154678

(51) Int. Cl.
*G07D 11/00* (2006.01)

(52) U.S. Cl.
CPC ..... *G07D 11/0042* (2013.01); *G07D 11/0006* (2013.01)

(58) Field of Classification Search
CPC .... G06Q 20/20; G07G 1/00; H01H 2231/006; G07D 11/0042; G07D 11/0006
See application file for complete search history.

(56) References Cited

U.S. PATENT DOCUMENTS

2010/0268377 A1* 10/2010 Pinney ..... G06F 19/3462 700/232
2014/0204365 A1* 7/2014 Frankenberger ..... G07D 7/128 356/71

FOREIGN PATENT DOCUMENTS

DE 10 2008 035 815 2/2010
DE 10 2010 004 669 7/2011
(Continued)

OTHER PUBLICATIONS

International Search Report of May 20, 2014.
(Continued)

*Primary Examiner* — Sonji Johnson
(74) *Attorney, Agent, or Firm* — Gerald E. Hespos; Michael J. Porco; Matthew T. Hespos

(57) ABSTRACT

The invention relates to a cash box (10) having a receiving area (12) for receiving notes of value, an invalidating unit (14), a sensor unit (18) for detecting manipulation attempts and a control unit (16). In an activated operating state, the control unit (16) triggers the invalidating unit (14) when the sensor unit (18) detects a manipulation attempt. In a deactivated operating state, the control unit (16) does not trigger the invalidating unit (14) even in the presence of a manipulation attempt. Prior to the activation of the cash box (10), the control unit (16) checks the proper functioning of at least one sensor (20) of the sensor unit (18). In addition, the invention relates to a method for activating a cash box (10).

14 Claims, 4 Drawing Sheets

(56) References Cited

FOREIGN PATENT DOCUMENTS

| | | | |
|---|---|---|---|
| DE | WO 2013023776 A1 * | 2/2013 | ..... G07D 7/128 |
| EP | 0 692 599 | 1/1996 | |
| EP | 2 463 831 | 6/2012 | |
| WO | 01/29786 | 4/2001 | |

OTHER PUBLICATIONS

European Search Report of Aug. 5, 2013.
International Appl. No. PCT/EP2014/052429—International Preliminary Report on Patentability—issued Aug. 11, 2015.

* cited by examiner

SELF-CHECKING CASH BOX

BACKGROUND

1. Field of the Invention

The invention relates to a cash box comprising a receiving area for receiving notes of value, an invalidating unit for irreversibly invalidating the notes of value arranged in the receiving area, a sensor unit having at least one sensor for detecting manipulation attempts and a control unit. In an activated operating state, the control unit triggers the invalidating unit when the sensor unit detects a manipulation attempt. In a deactivated operating state, on the other hand, the control unit does not trigger the invalidating unit in the presence of a manipulation attempt.

2. Description of the Related Art

A widely used method for securing notes of value received in cash boxes is to install in the cash box an invalidating unit, in particular a so-called ink kit, with which the notes of value can be invalidated in the case of manipulation attempts. In this way, the cash box is protected in particular when it is in an insecure environment, such as during the transport between a cash center and the automated teller machine, the automatic cash register system and/or the automatic cash safe into which it is to be inserted. When the ink kit is triggered, the notes of value received in the receiving area of the cash box are irreversibly inked with dye so that they cannot be put in circulation by a potential thief and are thus worthless for him/her.

The cash boxes are equipped with a plurality of sensors by means of which the presence of a manipulation attempt, i.e. the presence of an unauthorized access to the notes of value, shall be detected. If at least one of these sensors detects such a manipulation attempt, then the ink kit is triggered and the received notes of value are invalidated. By triggering the ink kit considerable damage occurs since not only the notes of value themselves are invalidated but also the cash box and possibly the surroundings in which the cash box is located when triggered are contaminated by the dye that is not easy to remove. Thus, it is particularly annoying when the ink kit is triggered although no manipulation attempt is present at all, for example because the cash box has been handled improperly by people handling the cash box or one of the manipulation sensors is defective and thus indicates a manipulation attempt although actually there is none.

From each of EP 2 463 831 A2 and DE 10 2010 004 669 A1 a cash box is known, in which a plurality of sensors for detecting manipulation attempts of the cash box are provided. When one of these sensors detects a manipulation attempt, an ink kit is triggered provided that the cash box is in an activated operating state.

DE 10 2008 035 815 A1 describes a cash box comprising a sensor via which an unauthorized opening of the cash output opening of the cash box can be detected.

From the non-prepublished German Patent Application 10 2011 035 443.1, a cash box is known that comprises a plurality of sensors for detecting manipulation attempts. Further, the cash box has a display via which individual operating states of the cash box can be displayed.

It is the object of the invention to specify a cash box and a method for activating a cash box, in which the risk of an unnecessary triggering of an invalidating unit of the cash box is minimized.

SUMMARY

According to the invention, the control unit checks the proper functioning of at least one sensor of the sensor unit prior to the activation. Activation shall mean the switching from the deactivated state into the activated operating state. As a result, it is achieved that it can be detected when the checked sensor does not function properly and thus an unnecessary false triggering of an invalidating unit by an incorrect signal of this sensor can be prevented in that, for example, this sensor is not taken into account or no activation of the cash box generally takes place.

The cash box can in particular comprise a receiving compartment in which the received notes of value are received in the form of a value note stack such that their front and rear sides abut each other and they stand on their edges. Alternatively, the cash box can also comprise a drum storage in which the received notes of value are stored such that they are wound between two foil ribbons. Each time, the invalidating unit is adapted to the corresponding embodiment and is designed such that the notes of value received in the receiving compartment or the notes of value wound onto the drum storage can be invalidated irreversibly.

The invalidating unit may be a so-called ink kit that comprises a dye stock, a gas pressure cartridge and an igniter. For triggering, the gas pressure cartridge is opened by the igniter so that the gas received therein under high pressure escapes and expels the dye from the dye stock like a shot via a spraying system so that the notes of value are inked with the dye. The igniter may be a blasting cap that can be controlled by the control unit of the cash box.

The sensor unit may comprise a plurality of sensors and when the control unit checks the proper functioning of at least two of these sensors prior to the activation. The control unit may check the proper functioning of all sensors of the sensor unit so that prior to the activation it is guaranteed that all sensors function properly and thus there will not be a false triggering due to a defective sensor.

The sensor unit may comprise at least one acceleration sensor, at least one position sensor for determining the position of the cash box and/or at least one humidity sensor. In addition, the cash box can comprise a shutter sensor by means of which it can be detected whether a shutter of the cash box is closed or not. The shutter in particular serves to close an opening of the cash box for the automatic filling and emptying of the cash box, as this takes place for example in automated teller machines, automatic cash register systems and automatic cash safes.

In addition, the sensor unit can comprise a cover sensor by means of which it can be determined whether a cover of the cash box is closed. The cover in particular serves to close an upper opening of the cash box via which the notes of value can be removed and fed manually and/or an access to the inside of the cash box for maintenance is possible.

In addition, a battery sensor for detecting the charge state of a battery of the cash box can be provided. Likewise, a trigger sensor can be provided by means of which it can be determined whether the trigger of the invalidating unit is correctly connected. Further, an identification sensor can be provided by means of which the identification of the box type of the cash box can be checked. In particular, two box types are distinguished, namely boxes having a drum storage and boxes having a receiving compartment in which the notes of value are received as a value note stack. In the respective electronic systems, in particular the same print is used, wherein it is however important for the control to define which box type is concerned. This is accomplished via a cable bridge which is plugged into correspondingly different plugs on the print.

The charge state of the battery may be determined continuously by means of the battery sensor. The control unit compares the respective determined measured values with a preset minimum limit. When the current state falls below this minimum limit, then by means of a display unit of the cash box it is displayed to the operator that the charge state of the battery has reached a critically low value, and it is necessary to charge the battery and/or to replace the battery by another battery. When the battery is fully discharged, the invalidating unit is preferably automatically triggered so that it is prevented that the sensor systems can be bypassed in that a thief waits until the battery is discharged and thus the sensors are no longer functioning.

A target signal value may be preset in the control unit for each sensor of the sensor unit that is to be checked prior to the activation. For checking the functioning of each of the sensors to be checked, the control unit each time determines an actual value of this sensor and compares the determined actual value to the respective target signal value. Dependent on the result of this comparison, the control unit defines whether the corresponding sensor and thus the entire sensor unit functions properly or whether there is an error or defect.

The control unit may determine the proper functioning of a sensor whenever the actual signal value of the sensor corresponds to the assigned target signal value of this sensor. Alternatively, the control unit may only determine the proper functioning when the actual signal value of a sensor deviates from an associated target signal value only within predetermined limits. In this way, it is achieved that small fluctuations of the sensor signal which may be conditioned by environmental influences and not necessarily signify a malfunctioning of the sensor are not interpreted incorrectly.

Additionally or alternatively, a target signal range with an upper and a lower limit value can be stored in the control unit for each sensor to be checked prior to the activation. For checking the functioning of each sensor to be checked, the control unit determines an actual signal value of the respective sensor and compares this actual signal value to the respective target signal range. The control unit determines the proper functioning when the actual signal value of the respective sensor lies within the respective assigned target signal range. In an alternative embodiment, also a target signal value can be stored for some sensors of the sensor unit and a target signal range can be stored for other sensors.

The control unit may only put the cash box from the deactivated into the activated operating state when for all sensors to be checked the check has revealed that these sensors function properly. In this way, it is guaranteed that there is no false triggering of the invalidating unit due to defective sensors. Alternatively, it is also possible that the cash box is put into the activated operating state despite a defective sensor but this sensor remains deactivated, i.e. that this sensor is not taken into account in the detection of manipulation attempts and thus there will be no triggering of the invalidating unit on the basis of this sensor signal.

The cash box may have an output unit for the output of information. The control unit may control this output unit such that the output unit outputs information on the proper functioning of the sensor unit and/or an information on the activation of the cash box when the check of the sensors to be checked has revealed that all sensors function properly. In this way, it is achieved that the operator receives a feedback and thus can be assured that the self-check of the cash box has been terminated positively and it has been put into the activated state.

The control unit may be configured so that if the check of at least one sensor reveals that this sensor does not function properly, the control unit does not activate the sensor unit so that there will be no false triggering due to defective sensors. In this case, the control unit controls the output unit in particular such that it outputs an error message with an information that at least one sensor is defective.

The output unit can be designed in the form of a displaying unit, for example a display. In this way, a simple output possibility for a plurality of different pieces of information is provided. Alternatively, also a monitor can be provided. Additionally or alternatively also any other form of a signal can be output via the cash box itself and/or via a device in which the cash box is inserted during the filling and/or emptying and/or during maintenance. For example, a receipt can be output.

When the control unit has determined that at least one sensor does not function properly, then after a predetermined period of time after displaying the error message, it may check once again the functioning of at least this sensor that had previously been determined as not functioning properly. Here, in particular the same method steps are executed as this is done during the first check. In this way, it is achieved that the operator has the possibility to eliminate the error or defect, if possible, and thus to still use the cash box. In an alternative embodiment, the re-check may also only be made when a corresponding operating command of the handling person has been input.

The sensors to be checked may be divided into a first group and at least a second group, with the first group comprising the sensors in which an error or defect can be eliminated by an operator, if necessary, and the second group comprising the sensors in which an error or defect can only be eliminated by way of a maintenance carried out by a service employee. In this way, it is achieved that the operator can easily determine whether it is useful that he/she at first tries to eliminate the error or defect by himself/herself or whether the cash box cannot be operated any longer without a previous repair by a service employee.

The control unit may perform the re-check within a predetermined period of time only for sensors of the first group since for sensors of the second group this is not useful anyway as these errors or defects cannot be eliminated by an operator anyway.

The display unit may display to an operator of the cash box whether the error or defect can be eliminated by him/her or not. The control unit generally does not activate the cash box when there is an error or defect of a sensor of the second group.

The sensor unit may be activated in the activated operating state and may be deactivated in the deactivated state the sensor unit is deactivated. Alternatively, the sensor unit can also be activated in both operating states, wherein, however, in the deactivated operating state of the cash box no evaluation of received sensor signals takes place so that dependent on the determined sensor signals no triggering of the invalidating unit takes place.

The cash box may have a memory element, and the control unit may store the determined actual signal values and/or the comparison results in this memory element. In particular, the cash box further has a plug connector via which a data transmission connection to the cash box can be established by connecting a complementary plug connector. Via this data transmission connection the data stored in the memory element can be read out so that a service employee can easily determine which sensor is defective and thus can quickly eliminate the error or defect. The reading out of the stored data in particular takes place when the cash box is inserted into a docking station of a cash center or another device. When the cash box is inserted into this device, the plug connection is in particular established automatically.

A further aspect of the invention relates to a method for activating a cash box which is in the deactivated operating state, in which method a control unit of the cash box checks the proper functioning of at least one sensor for detecting manipulation attempts of a sensor unit of the cash box after the input of an activation command by an operator. The control unit of the cash box only switches the cash box from the deactivated operating state to an activated operating state when the check reveals that all sensors of the sensor unit which are to be checked function properly. The deactivated operating state is in particular an operating state in which also in the presence of a manipulation attempt an invalidating unit of the cash box is not triggered, wherein in the activated operating state the invalidating unit is triggered when a manipulation attempt is determined by means of the sensor unit.

The afore-described method can be developed with the features of the independent device claim and/or the features of the claims which are dependent on the independent device claim or corresponding method features.

Further features and advantages of the invention result from the following description which explains the invention in more detail on the basis of embodiments in connection with the enclosed Figures.

DETAILED DESCRIPTION

Figure 1:
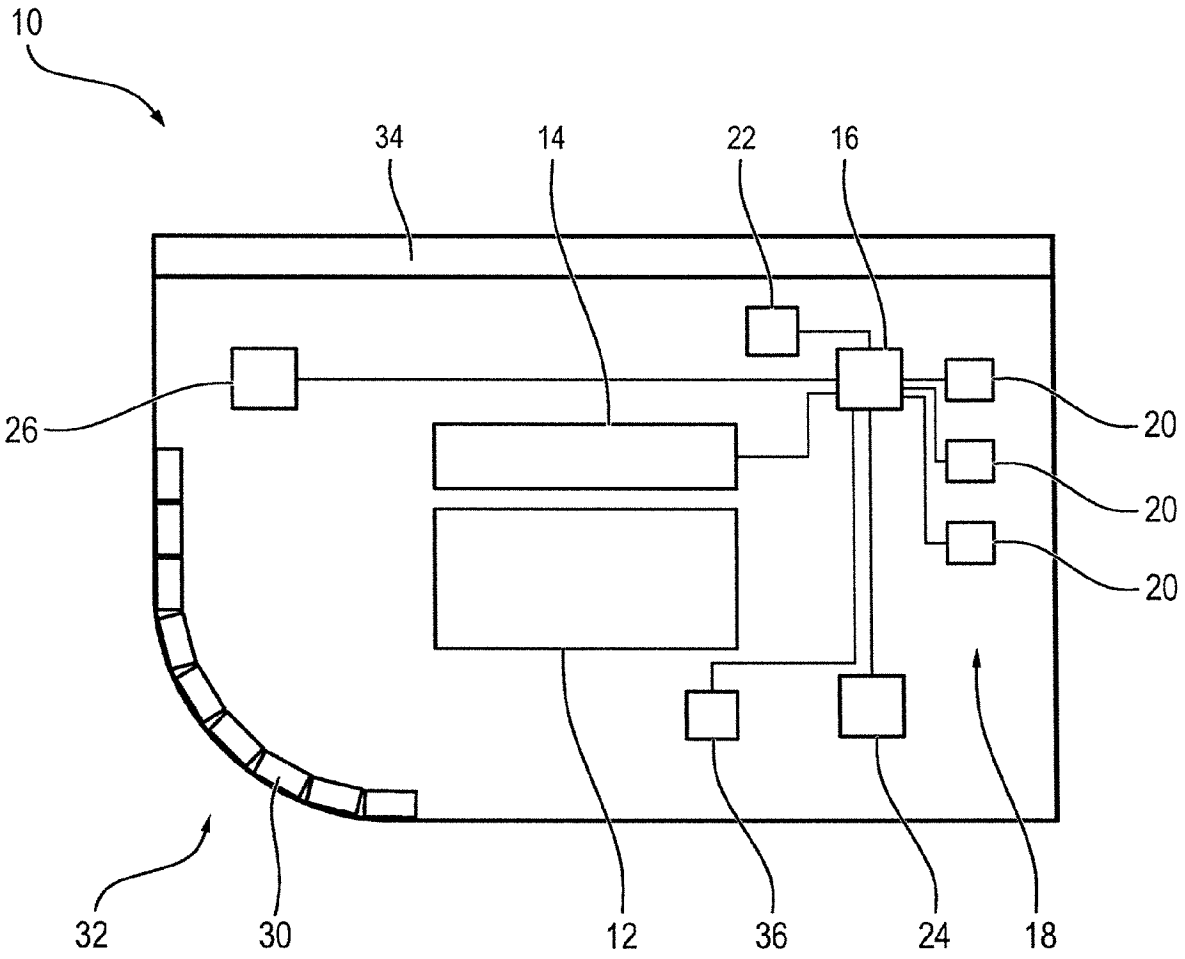
FIG. 1 shows a schematic illustration of a cash box.

In FIG. 1, a schematic illustration of a cash box 10 is shown. The cash box 10 comprises a receiving area 12 in which notes of value can be received. Here, the receiving area 12 can be designed in the form of a receiving compartment in which the notes of value are received standing on their edges and abutting each other with their front and/or rear sides. Alternatively, also a drum storage can be provided in which the notes of value are wound onto a winding drum arranged between two foil ribbons.

Further, an invalidating unit 14 by means of which the notes of value received in the receiving area 12 can be invalidated irreversibly is provided in the cash box 10. The invalidating unit 14 is in particular designed in the form of a so-called ink kit. Such ink kits comprise a dye container filled with dye, a gas pressure cartridge and an igniter that can be triggered electronically. The igniter in particular has a blasting cap which, when ignited, shoots a bolt through a burst disk of the gas pressure cartridge so that the gas received in the gas pressure cartridge under high pressure enters the dye container and sprays the dye out of this container and onto the notes of value via a spraying system. As a result, the received notes of value are inked irreversibly and thus cannot be put in circulation by the thief and are worthless to him/her.

In addition, a control unit 16 is provided by means of which inter alia the invalidating unit 14 can be controlled, in particular triggered. The control unit 16 can in particular trigger the invalidating unit 14 when the manipulation attempt has been detected by means of a sensor unit 18. The sensor unit 18 comprises a plurality of different sensors 20, by means of which various safety-relevant aspects of the cash box 10 can be monitored and which serve to prevent as many potential manipulation attempts as possible in that these are detected so that the invalidating unit 14 can be triggered and the notes of value can be inked. In addition, a memory element 22 is provided in which data can be stored by the control unit 16. Via a plug connector 24 arranged on the housing of the cash box 10, a data transmission connection between the cash box 10 and a device in which it is received, for example a docking station, an automated teller machine, an automatic cash register system and/or an automatic cash safe can be established. Via this data transmission connection, the data stored in the memory element 22 can be read out and further control information can be transmitted to the control unit 16.

In addition, a display 26 is provided on the cash box 10 via which, as will be described in more detail in the following in connection with the activation and deactivation, information can be output to a person handling the cash box 10. As an alternative to a display 26, any other suitable displaying unit for the output of information can be used. For example, a monitor can be used.

As sensors 20 of the sensor unit 18 a large variety of different sensors 20 can be used. For example, an acceleration sensor can be used by means of which accelerations of the cash box 10 can be detected. In addition, humidity sensors can be employed. Further, in particular a position sensor can be used by means of which the position of the cash box relative to the horizontal can be determined.

In addition, in particular a shutter sensor is provided by means of which it is monitored whether a shutter 30 of the cash box 10 is closed. Via this shutter 30 an opening 32 can be closed via which the notes of value 12 received in the receiving area 12 can be removed automatically when the cash box 10 is inserted into a corresponding device for handling notes of value or via which notes of value can be fed when the shutter 30 is open.

Moreover, the sensor unit 18 can comprise a cover sensor by means of which it can be monitored whether a cover 34 of the cash box 10 is closed.

In addition, a battery sensor can be provided, by means of which the charge state of a battery 36 for supplying the cash box 10 with electrical energy can be determined. The battery is in particular a rechargeable battery 36, i.e. an accumulator.

Further, an identification sensor can be provided, by means of which it can be determined that the cash box 10 is a cash box 10 having a receiving compartment or a cash box 10 having a drum storage. Further, the sensor unit 18 in particular comprises a trigger sensor, by means of which it can be determined whether a trigger of the invalidating unit 14 is properly connected.

Figure 2:
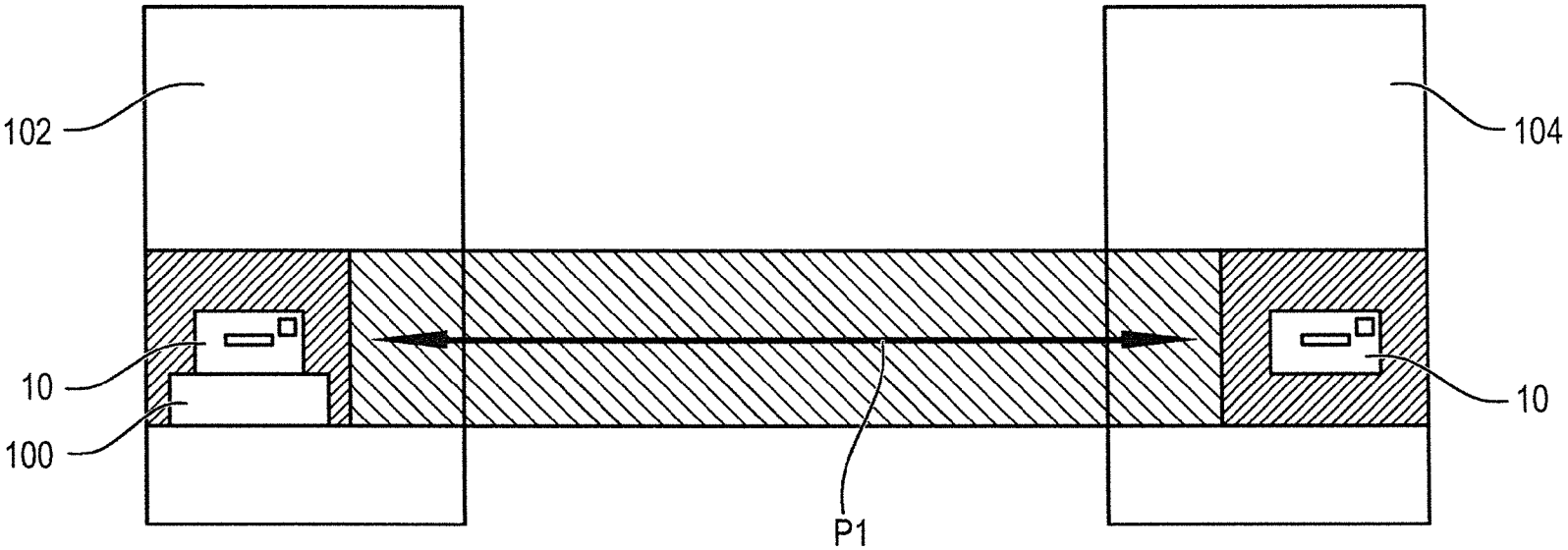
FIG. 2 shows a schematic illustration of a handling process of the cash box according to FIG. 1.

In FIG. 2, a schematic illustration of a transport process of the cash box 10 is illustrated. For emptying the cash box 10 and/or for filling the cash box 10, it is arranged in a docking station 100 of a cash center 102. After the cash box 10 has been properly filled with the notes of value, it is removed from the docking station 100 and fed, for example, to an automated teller machine 104 and inserted into a corresponding receiving compartment of this automated teller machine 104. The transport between the cash center 102 and the automated teller machine 104 is indicated symbolically in FIG. 2 by the double arrow P1.

In operation, the cash box 10 can be operated in a so-called activated operating state and in a so-called deactivated operating state, wherein the cash box 10 is operated in the deactivated operating state when received in the docking station 100 or in the automated teller machine 104 and is activated in the activated operating state during the transport. The activated operating state is illustrated in FIG. 2 by the partial area of the transport path hatched from the upper left side to the lower right side, the deactivated operating state is illustrated by the area hatched from the lower left side to the upper right side. Here, it becomes obvious that the switching from the deactivated in the activated operating state already takes place before the cash box leaves the cash center or prior to the complete removal from the automated teller machine so that the entire transport reliably takes place in the activated operating mode.

During the activated operating mode, the sensors 20 of the sensor unit 18 are activated and the control unit 16 triggers the invalidating unit 14 when at least one of the sensors 20 detects a manipulation attempt.

In the deactivated operating state, on the other hand, the control unit 16 does not trigger the invalidating unit 14 in the presence of a manipulation attempt. For this, for example the sensor unit 18 can be deactivated. Alternatively, also the sensors 20 of the sensor unit 18 can still remain active, i.e. that they still supply measured values which are, however, not evaluated in the deactivated operating state.

In the deactivated operating mode, it is possible during the reception in the cash center 102 or in the automated teller machine 104 that the shutter 30 and/or the cover 34 can be opened without the invalidating unit 14 being triggered. During the transport, on the other hand, an opening of the cover 34 or of the shutter 30 would cause a triggering so that the notes of value would be inked and would be useless for a thief. Correspondingly, also the other sensors 20 of the sensor unit 18 serve to detect possible manipulation attempts during the transport and thus to allow a safe transport.

Figure 4:
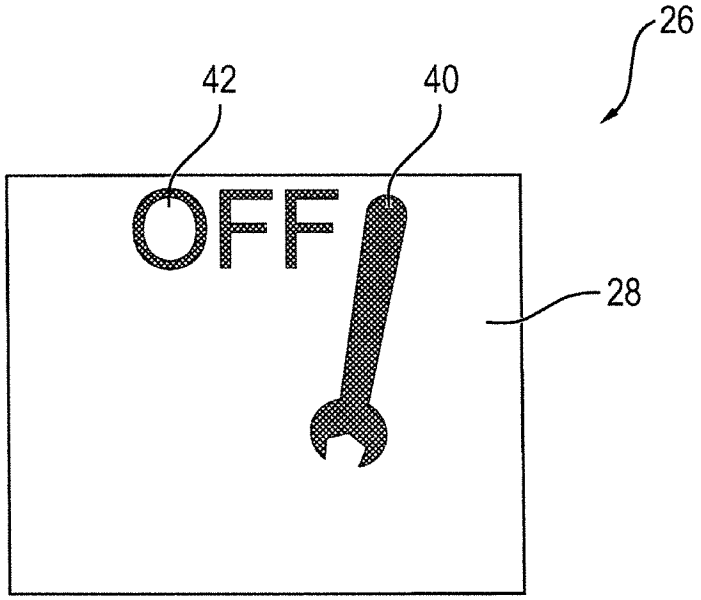
FIG. 4 shows a further illustration of the readings of the display according to FIG. 3.
Figure 3:
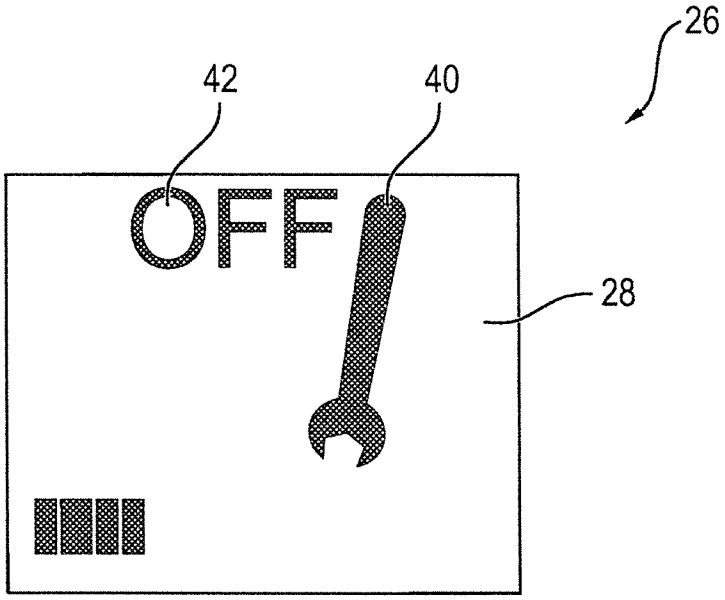
FIG. 3 shows a schematic illustration of the readings of a display of the cash box according to FIG. 1.

The operating mode in which the cash box 10 is currently operated each time can in particular be illustrated by means of a reading 28 of the display 26, as illustrated in FIGS. 3 and 4. The wrench symbol 40, for example, indicates that a maintenance of the cash box 10 is required. Via the OFF symbol 42, it is indicated that the invalidating unit 14 is deactivated and thus would not be triggered even if one of the sensors 20 were to detect a manipulation attempt.

By means of the sensor unit 18 a high degree of safety can be guaranteed during the transport of the cash box 10. What is however problematic is that a triggering of the invalidating unit 14 may also occur when the cash box is operated in the activated operating mode and when no manipulation attempt is present at all, for example when the cash box 10 is handled improperly or one of the sensors 20 of the sensor unit 18 does not function properly and thus provides a signal that usually would suggest a manipulation attempt but is generated due to the defective functioning of the sensor.

Figure 5:
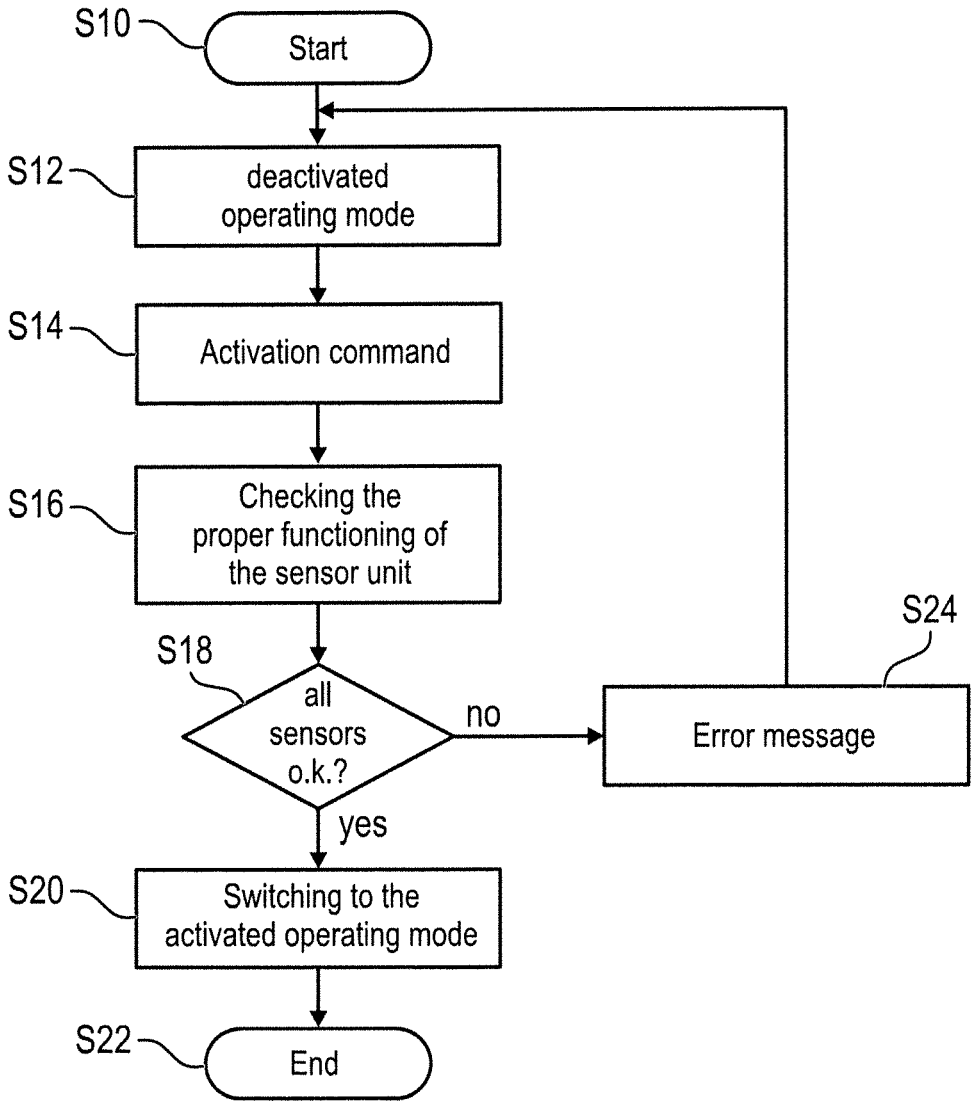
FIG. 5 shows a flow chart of a method for activating a cash box which is in a deactivated operating state.

In FIG. 5, a flow chart of a method for activating the cash box 10 is illustrated, wherein activating shall mean the switching from the deactivated operating state to the activated operating state.

When the method is started in step S10, the cash box 10 is in the deactivated operating state (S12). After in step S14 an activation command for switching the cash box from the deactivated to the activated operating mode or for activation has been given, the control unit 16 checks in step S18 the proper functioning of the sensors 20 of the sensor unit 18.

The activation command is in particular input manually by a person handling the cash box 10. Alternatively, the activation command can also be generated automatically when the cash box 10 is removed from the device 100, 104 in which it had previously been received. For example, this removal can be detected by disconnecting the plug connection established via the plug connector 24.

In the control unit 16 or the memory element 22, one target signal value each and/or one target signal range each is stored for all sensors 20 to be checked. For a check, the control unit 16 determines in particular for each sensor 20 to be checked one actual signal value each and compares this value with the target signal value or the target signal range. When the first signal value lies within the target signal range or when the actual signal value corresponds to the target signal value or when there is only a slight deviation within predetermined limits, then it is assumed that the corresponding sensor 20 functions properly.

In step S16, in particular all sensors 20 of the sensor unit 18 are checked. In an alternative embodiment, also only some of the sensors 20 may be checked. In step S16, also sensors 20 may be checked which are not required during transport, i.e. are not activated or the signals of which are used for triggering the invalidating unit 16 in other operating modes. Indeed, in the case of such sensors 20 there is no direct risk of a false triggering during the transport, but nevertheless their functioning is important for the entire operational procedure so that it might be useful to also check their functioning.

In step S18, the control unit determines whether all sensors 20 to be checked function properly. If this is the case, then the control unit 16 switches in step S20 from the deactivated operating mode to the activated operating mode so that now a triggering of the invalidating unit 14 would take place when a manipulation attempt is detected by the sensor unit 18. Subsequently, the method is terminated in step S22.

In a preferred embodiment, in addition a message is output to the operator in step S20 that the check has revealed that all sensors 20 function properly and the cash box 10 has been switched to the activated operating mode accordingly. This can, for example, be accomplished via a receipt and/or via a reading on the display unit 26.

If, on the other hand, it is determined in step S18 that at least one of the sensors 20 to be checked does not function properly, then in step S24 an error message is output to the operator and the cash box 10 is maintained in the deactivated operating mode. Here, too, the error message can be output in the form of a receipt and/or a reading via the display unit 26.

In a preferred embodiment, the actual signal values determined for checking and/or the comparison results are stored in the memory element 22 so that the stored data can be read out during the maintenance of the cash box 10, for example in the cash center 102, via the data transmission connection that can be established via the plug connector 24. Thus, service employees can easily get an overview on the functionality of the cash box 10 and, if necessary, eliminate errors or defects in a targeted and quick manner.

The different sensors 20 can in particular be divided into groups, wherein the first group comprises the sensors 20 in which an improper functioning can be attributed to a user error, and wherein those sensors 20 are classified in group 2 in which an improper functioning is to be attributed to a system error. User errors shall mean errors or defects which can be eliminated by the user himself and after the elimination of which another activation command and thus another try for an activation may be useful. System errors, on the other hand, shall mean errors or defects in which most probably a defect of the corresponding sensor 20 is present which cannot readily be eliminated by the user.

Among the first group are in particular the cover sensor, the shutter sensor, the battery sensor and the trigger sensor, whereas among the second group there are in particular the identification sensor, the acceleration sensor, the humidity sensor and the position sensor. With respect to the cover sensor, a user error can, for example, be that the cover 34 is still open when the activation command is input. Accordingly, a user error with respect to the shutter sensor can be that the shutter 30 is still open during activation. The cause for a faulty signal value of the battery sensor can, for example, be that the battery only has a low charge state and thus must be replaced. A deviating signal value of the trigger sensor can, for example, be attributed to the fact that the trigger is not properly connected and thus has to be connected properly by the user.

Regarding the sensors classified in group 2, it has to be assumed that the sensor 20 itself or the cables via which the sensor 20 is connected to the control unit 16 is defective and thus a maintenance of the cash box 10 is required when the current signal value deviates from the target signal range.

LIST OF REFERENCE SIGNS

10 cash box
12 receiving area
14 invalidating unit
16 control unit
18 sensor unit
20 sensor
22 memory element
24 plug connector
26 display
28 reading
30 shutter
32 opening
34 cover
40, 42 symbol
100 docking station
102 cash center
104 automated teller machine
P1 arrow
S10 to S24 method step

The invention claimed is:

1. A cash box, comprising:

a receiving area (12) configured for receiving notes of value, an invalidating unit (14) configured for irreversibly invalidating notes of value arranged in the receiving area (12), a sensor unit (18) having at least one sensor (20) configured for detecting manipulation attempts, and a control unit (16) configured for checking proper functioning of at least one sensor (20) of the cash box (10) and for controlling the invalidating unit (14), wherein the control unit (16) establishes an activated operating state if the at least one sensor (20) of the cash box (10) is determined to be functioning properly, establishes a deactivated operating state if the at least one sensor (20) of the cash box (10) is determined not to be functioning properly, and triggers the invalidating unit in the activated operating state when the sensor unit (18) detects a manipulation attempt and does not trigger the invalidating unit (14) in the presence of a manipulation attempt in the deactivated operating state, and the control unit (16) being configured for checking proper functioning of the at least one sensor (20) of the sensor unit (18) prior to the activation of the cash box.

2. The cash box (10) of claim 1, wherein the sensor unit (18) comprises a plurality of sensors (20), and that the control unit (16) is configured to check the proper functioning of at least two sensors (20) of the sensor unit (18) prior to the activation of the cash box.

3. The cash box (10) of claim 1, wherein the sensor unit (18) comprises at least one acceleration sensor, at least one position sensor, at least one humidity sensor, a shutter sensor configured for detecting a closed state of a shutter (30) of the cash box (10), a cover sensor configured for detecting a closed state of a cover (34) of the cash box (10), a battery sensor configured for determining a charge state of a battery (36) of the cash box (10), a trigger sensor configured for detecting connection of a trigger of the invalidating unit (14) and/or an identification sensor configured for determining an identification of the cassette type of the cash box (10).

4. The cash box (10) of claim 1, wherein the control unit (16) has a target signal value stored therein for each sensor (20) prior to the activation of the cash box and the control unit (16) is configured to determine an actual signal value of the respective sensor (20) and to compare this determined actual signal value to the respective target signal value for checking the functioning of each sensor (20).

5. The cash box (10) of claim 4, wherein the control unit (16) is configured to determine the proper functioning of a sensor (20) whenever the actual signal value of the sensor (20) corresponds to the assigned target signal value and/or when the actual signal value of the sensor (20) deviates from the assigned target signal value only within predetermined limits.

6. The cash box (10) of claim 1, wherein the control unit (16) has a target signal range with an upper and a lower limit value stored therein for each of the sensors (20) prior to the activation of the cash box, the control unit (16) being configured to determine an actual signal value of each sensor (20) for checking the functionality of the respective sensor (20) and to compare the determined actual signal value to the respective target signal range, and to determine the proper functioning of a sensor (20) whenever the actual signal value of the sensor (20) lies in the assigned target signal range.

7. The cash box (10) of claim 1, wherein the control unit (16) is configured to only put the cash box (10) from the deactivated into the activated operating state when the check for all sensors (20) has revealed that these function properly.

8. The cash box (10) of claim 7, wherein the cash box (10) further comprises an output unit (26) configured for outputting information, and the control unit (16) is configured to control the output unit (26) such that the output unit (26) outputs an information about the proper functioning of the sensor unit (18) and/or an information about the activation.

9. The cash box (10) of claim 8, wherein the control unit (16) is configured not to activate the sensor unit (18) when the check of at least one sensor (20) reveals that this sensor does not function properly and to control the output unit (26) such that the output unit (26) outputs an error message with an information thereon.

10. The cash box (10) of claim 9, wherein the control unit (16) once again checks the functioning of at least those sensors (20) previously determined as not functioning properly after a predetermined period of time after the output of the error message.

11. The cash box (10) of claim 10, wherein the sensors (20) are divided into a first group and into at least a second group, the first group comprises the sensors (20) in which an error or defect is of a first specified type that is eliminated by an operator, if necessary, and the second group comprises sensors (20) in which an error or defect of a second specified type that requires a maintenance to be carried out by a service employee, and the control unit (16) is configured to carry out the re-check after the predetermined period of time only for the sensors (20) of the first group.

12. The cash box (10) of claim 1, wherein the sensor unit (18) is activated in the activated operating state and is deactivated in the deactivated operating state.

13. The cash box (10) of claim 1, wherein the cash box (10) comprises a memory element (22), and the control unit (16) is configured to store the determined actual signal values and/or the comparison results in the memory element (22).

14. The cash box (10) of claim 13, wherein the cash box (10) comprises a plug connector (24) and the data stored in the memory element (22) is read out by establishing a data transmission connection by connecting a complementary plug connector.

* * * * *